US008110142B2

(12) United States Patent
Barrett et al.

(10) Patent No.: US 8,110,142 B2
(45) Date of Patent: Feb. 7, 2012

(54) HIGH YIELD LADLE BOTTOMS

(75) Inventors: Ronald Barrett, Fenelton, PA (US); Donald Abrino, Curwensville, PA (US)

(73) Assignee: North American Refractories Co., Moon Township, PA (US)

( * ) Notice: Subject to any disclaimer, the term of this patent is extended or adjusted under 35 U.S.C. 154(b) by 118 days.

(21) Appl. No.: 12/032,720

(22) Filed: Feb. 18, 2008

(65) Prior Publication Data

US 2009/0206528 A1 Aug. 20, 2009

(51) Int. Cl.
*C21C 5/44* (2006.01)
*B22D 41/08* (2006.01)

(52) U.S. Cl. ..... 266/283; 266/275; 266/200; 266/236; 222/594; 222/590; 222/591

(58) Field of Classification Search ..... 266/274, 266/275, 200, 236, 283; 222/590, 591, 594
See application file for complete search history.

(56) References Cited

U.S. PATENT DOCUMENTS

| | | | | |
|---|---|---|---|---|
| 3,603,050 | A * | 9/1971 | Coleman | 52/249 |
| 4,601,415 | A | 7/1986 | Koffron | 222/597 |
| 4,709,903 | A | 12/1987 | LaBate | 266/227 |
| 4,746,102 | A | 5/1988 | Gilles et al. | 266/236 |
| 4,968,007 | A | 11/1990 | Forte et al. | 266/100 |
| 5,171,513 | A | 12/1992 | Vassilicos | 266/230 |
| 5,196,051 | A | 3/1993 | Heaslip et al. | 75/582 |
| 5,382,003 | A | 1/1995 | Sankaranarayanan et al. | 266/230 |
| RE35,597 | E | 8/1997 | Vassilicos | 266/230 |
| 5,879,616 | A | 3/1999 | Erny | 266/45 |
| 5,948,349 | A * | 9/1999 | Beurotte et al. | 266/44 |
| RE37,417 | E | 10/2001 | Koffron | 266/230 |
| 6,673,306 | B2 | 1/2004 | Abrino et al. | 266/275 |
| 6,723,275 | B2 | 4/2004 | Koffron et al. | 266/45 |
| 6,787,098 | B2 | 9/2004 | Abrino et al. | 266/44 |
| 7,112,300 | B2 | 9/2006 | Richard et al. | 266/275 |
| 2002/0153645 | A1 * | 10/2002 | Abrino et al. | 266/280 |
| 2005/0127582 | A1 * | 6/2005 | Richaud et al. | 266/200 |
| 2007/0132162 | A1 * | 6/2007 | Barrett | 266/283 |

* cited by examiner

*Primary Examiner* — Roy King
*Assistant Examiner* — Lois Zheng
(74) *Attorney, Agent, or Firm* — Kusner & Jaffe

(57) ABSTRACT

A refractory bottom for a metallurgical vessel comprised of a bottom lining having a bottom surface that is dimensioned to overlay a bottom of a metallurgical vessel and an upper surface. The upper surface is comprised of a plurality of discrete sections that include an uppermost section, an intermediate section and a lowermost section. Each section has an upper surface at a discrete elevation such that the upper surface of the uppermost section has a highest elevation and the upper surface of the lowermost section has a lowest elevation. The upper surface of the uppermost section, the intermediate section and the lowermost section comprise a series of successive stepped sections that define a stepped path from the uppermost section downward to the lowermost section. Each successive section of the upper surface is lower than a preceding section.

22 Claims, 7 Drawing Sheets

HIGH YIELD LADLE BOTTOMS

FIELD OF THE INVENTION

The present invention relates generally to refractory linings for metallurgical vessels, and more particularly to a lining bottom for such vessels. The invention is particularly applicable for use in ladles used in handling molten steel, and will be described with particular reference thereto. It will, of course, be appreciated that the present invention has application in other types of metallurgical vessels for handling molten metal.

BACKGROUND OF THE INVENTION

In the manufacture of steel, molten steel is poured from a metallurgical furnace into a ladle. In pouring the liquid metal from the metallurgical furnace, there is typically some carry-over of slag from the furnace into the ladle. The molten steel may also undergo further refinement in the ladle. In this respect, various slag-forming constituents may be added to the liquid steel in the ladle to aid in the refinement process. Thus, the ladle will typically contain molten steel with a layer of slag floating on top of the steel.

The molten steel typically is cast, i.e., drained, from the ladle through a well block in a bottom of the ladle. A slide gate or stopper rod serves to open a channel through which the liquid metal exits the ladle. During the casting process, slag particles can become entrained in the stream of liquid steel exiting the ladle. Entrainment can be caused by vortexing, i.e., swirling, in the vicinity of the well block. Vortexing may occur once the level of the liquid metal in the ladle drops to a critical level. The level of steel in the ladle will eventually drop to a point where slag may also be pulled directly into the stream of liquid steel exiting the ladle, even in the absence of vortexing. The slag particles cause contamination of the liquid metal thereby causing the resulting steel to be of lower quality.

To avoid contamination of the steel by slag, casting is generally terminated before the level of liquid metal in the ladle reaches the critical level at which slag may be entrained. This results in a certain amount of liquid metal being left in the ladle. This residual liquid metal represents lost production, and is referred to as a "decrease in yield." To increase yield, steelmakers endeavor to allow the level of the liquid steel in the ladle to fall to as low a level as possible before stopping the casting operation.

The present invention provides a ladle bottom that increases the yield of slag-free steel from a steel-making ladle and reduces the entrainment of slag into the stream of liquid metal.

SUMMARY OF THE INVENTION

In accordance with the present invention, there is provided a refractory bottom for a metallurgical vessel comprised of a bottom lining having a bottom surface that is dimensioned to overlay a bottom of a metallurgical vessel and an upper surface. The upper surface is comprised of a plurality of discrete sections that include an uppermost section, an intermediate section and a lowermost section. Each section has an upper surface at a discrete elevation such that the upper surface of the uppermost section has a highest elevation and the upper surface of the lowermost section has a lowest elevation. The upper surface of the uppermost section, the intermediate section and the lowermost section comprise a series of successive stepped sections that define a stepped path from the uppermost section downward to the lowermost section. Each successive section of the upper surface is lower than a preceding section. An opening extends through the lowermost section of the bottom lining to allow a molten metal to drain from the vessel.

In accordance with another aspect of the present invention, there is provided a refractory bottom for a metallurgical vessel comprised of a bottom lining. The bottom lining has an upper surface comprised of an uppermost section, an intermediate section and a lowermost section. The sections define a path from the uppermost section to the lowermost section. The path is comprised of successive stepped sections. Each section defines a step in the path and each successive step is lower than a preceding step. An opening extends through the lowermost section of the bottom lining to allow molten metal to drain from a metallurgical vessel.

An advantage of the present invention is the provision of a refractory bottom lining for a ladle used in a steel making process Another advantage of the present invention is the provision of a refractory bottom lining, as described above that aids in the flow of molten metal in the ladle as the molten metal is drained from the ladle.

Another advantage of the present invention is the provision of a bottom lining, as described above that is designed to minimize the amount of slag entrained in the molten metal as the molten metal is drained from the ladle.

A still further advantage of the present invention is the provision of a bottom lining, as described above that captures slag on sections of the bottom lining as the molten metal is drained from the ladle.

Still another advantage of the present invention is the provision of a bottom lining, as described above that reduces the volume of molten metal remaining in the ladle when the flow of molten metal from the ladle ceases.

Still another advantage of the present invention is the provision of a bottom lining, as described above that increases a yield of molten metal by allowing more slag-free, molten metal to be drained from the ladle.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
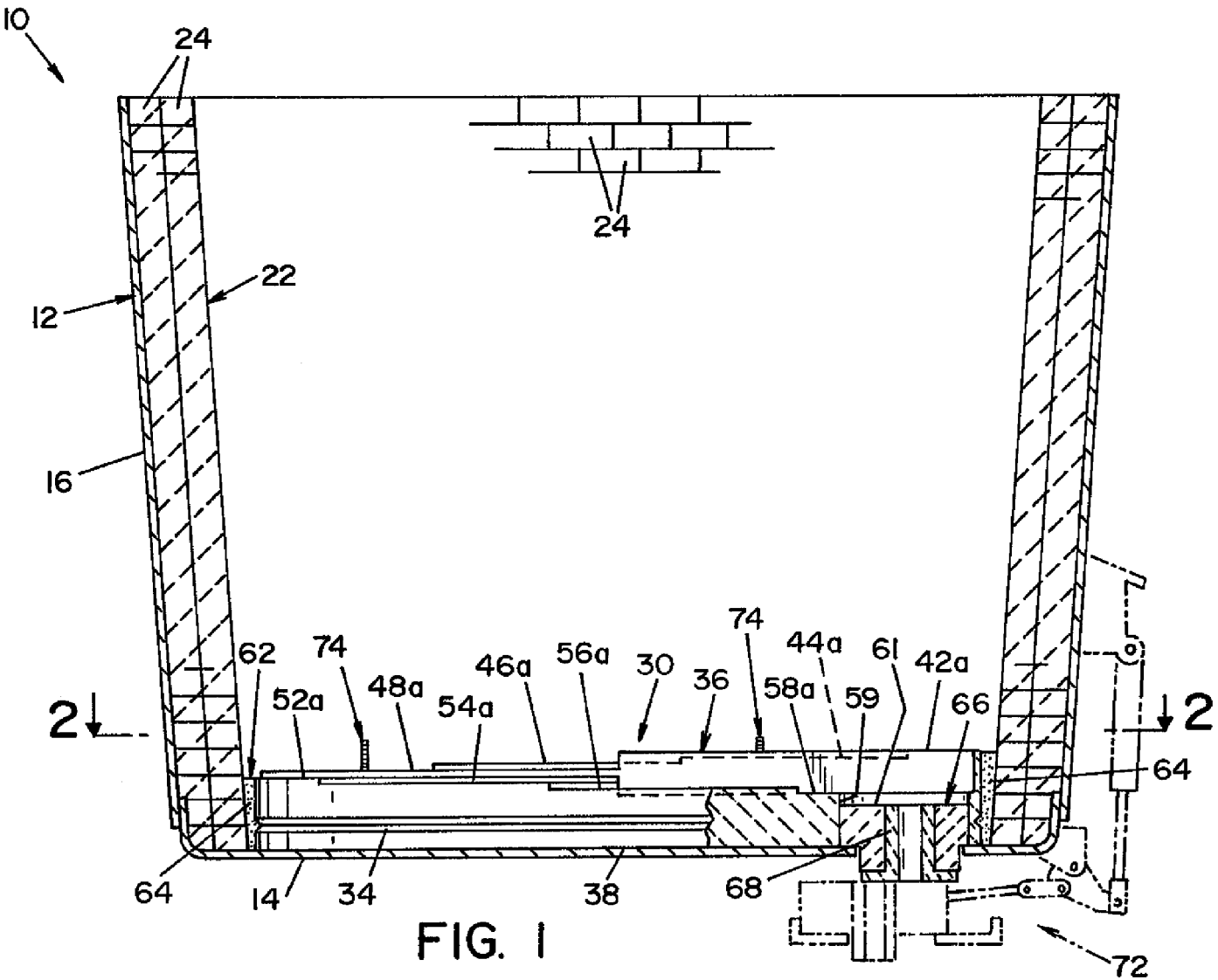
FIG. 1 is a side, sectional view of a ladle for handling molten metal, showing a bottom lining of the ladle according to a first embodiment of the present invention.

Referring now to the drawings wherein the showings are for the purposes of illustrating preferred embodiments of the invention only and not for the purposes of limiting the same, the present invention relates generally to a refractory lining for a metallurgical vessel. The invention is particularly applicable to a steel ladle used in handling molten steel, and will be described in particular reference thereto. It will be appreciated from a further reading of the specification, that the invention is not limited to a steel ladle, but may find advantageous application for linings used in other types of metallurgical vessels handling molten metal.

FIG. 1 shows a conventional steel ladle 10 generally comprised of an outer metallic shell 12. Shell 12 has a cup-shaped bottom 14 and a slightly conical side wall 16. A refractory lining 22, comprised of two layers of refractory brick 24, is disposed along the inner surface of side wall 16. In the embodiment shown, refractory lining 22 of refractory bricks 24 extends along the entire length of side of wall 16 from bottom 14 to the open upper end of ladle 10, as best seen in FIG. 1.

A bottom lining 30 (best seen in FIG. 3) is dimensioned to be disposed on bottom 14 of metallic shell 12. Bottom lining 30 is basically comprised of a refractory material. In this respect, bottom lining 30 may be comprised of a refractory castable, refractory bricks or a combination of a refractory castable and refractory bricks.

Bottom lining 30 is dimensioned to cover and rest upon bottom 14 of shell 12. In the embodiment shown, bottom lining 30 is essentially oblong in shape, and is dimensioned to have a lower surface 38. Lower surface 38 is dimensioned to match oblong bottom 14 of shell 12. A V-shaped slot 34, best seen in FIG. 3, is formed in the peripheral edge of bottom lining 30 to secure bottom lining 30 in ladle 10, as shall be described in greater detail below.

Figure 2:
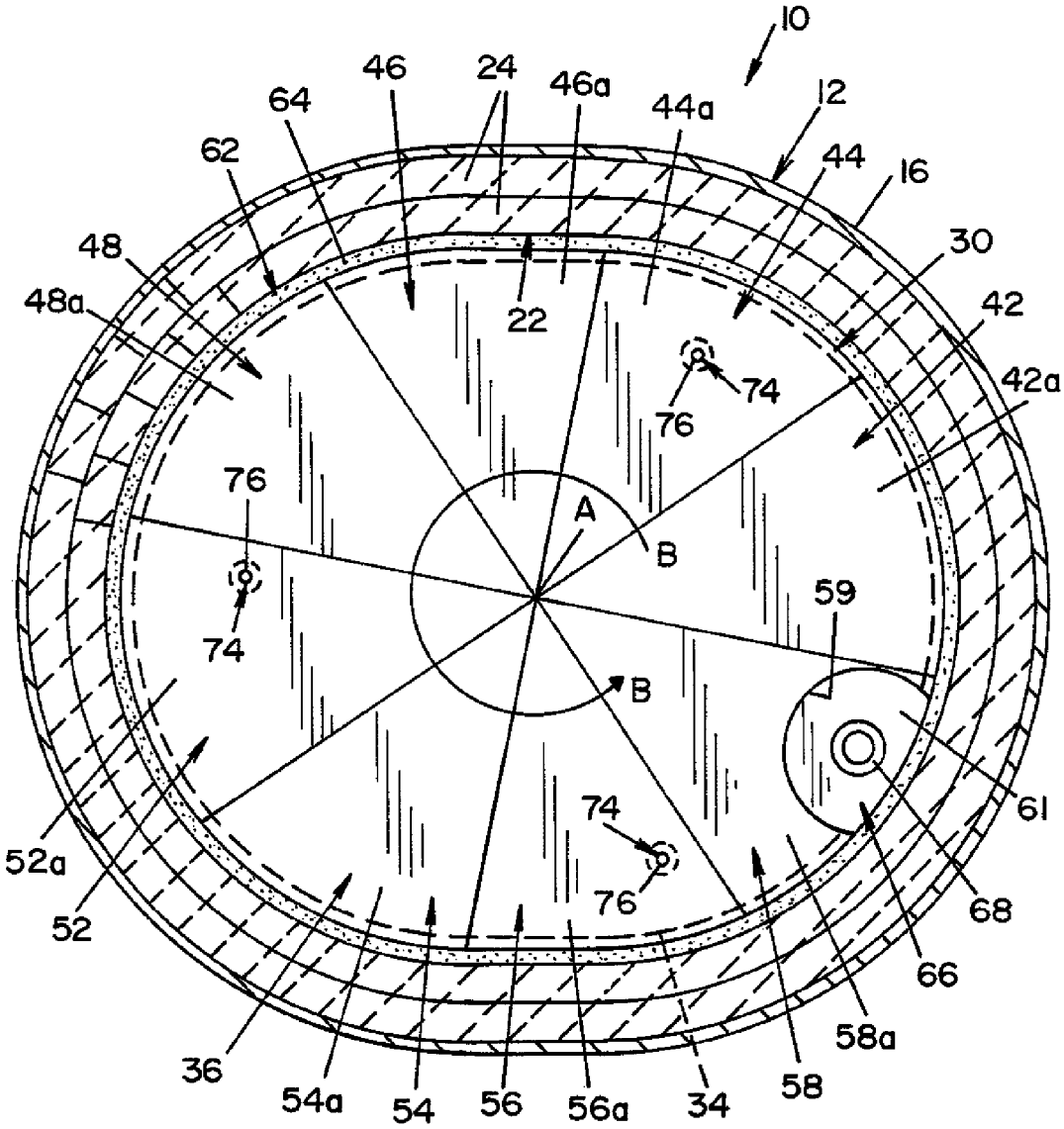
FIG. 2 is a sectional view taken along lines 2-2 of FIG. 1.
Figure 3:
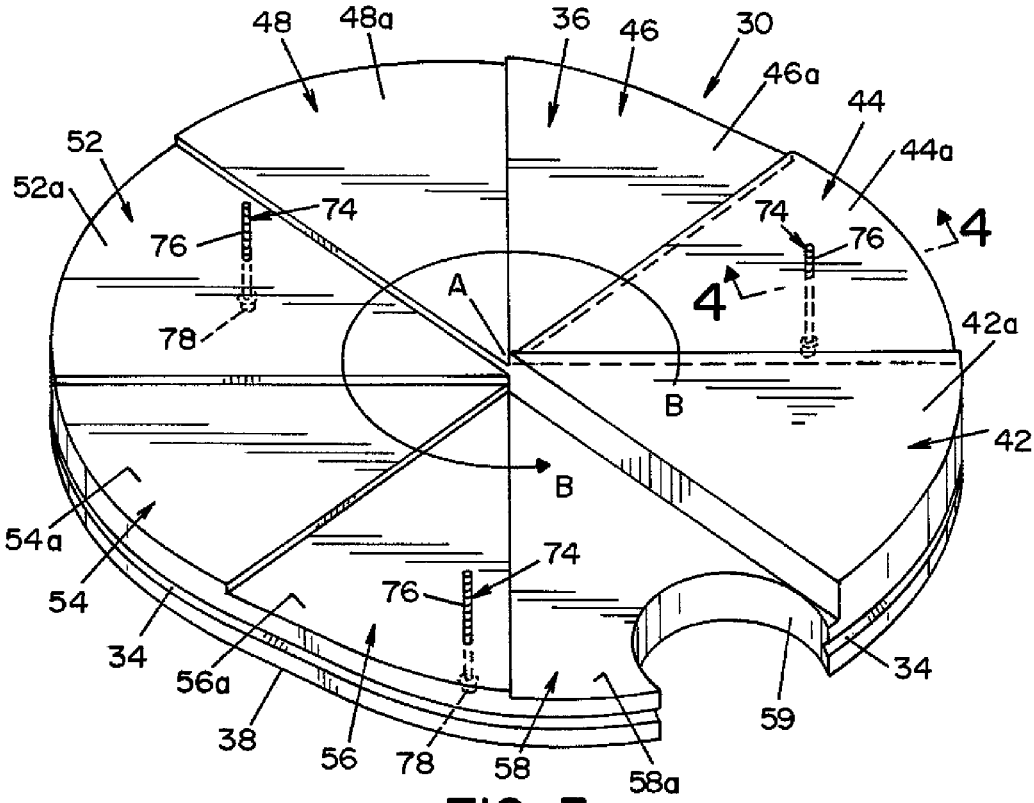
FIG. 3 is a perspective view of a bottom lining as shown in FIGS. 1 and 2.

Referring now to FIGS. 1-3, bottom lining 30, illustrating a first embodiment of the present invention, is shown. Bottom lining 30 has an upper portion comprised of discrete sections. In the embodiment shown, the upper portion of bottom lining 30 is comprised of an uppermost section 42, six (6) intermediate sections 44, 46, 48, 52, 54, 56 and a lowermost section 58. Uppermost section 42, intermediate sections 44, 46, 48, 52, 54, 56 and lowermost section 58 are each basically pie-shaped. Uppermost section 42, intermediate sections 44, 46, 48, 52, 54, 56 and lowermost section 58 are arranged such that each section extends from a center point "A," best seen in FIG. 2. An opening 59 extends through the portion of bottom lining 30 defining lowermost section 58. Uppermost section 42 has an upper surface 42*a*, intermediate section 44 has an upper surface 44*a*, intermediate section 46 has an upper surface 46*a*, and so forth. Surfaces 42*a*, 44*a*, 46*a*, 48*a*, 52*a*, 54*a*, 56*a*, 58*a* are each disposed at a discrete elevation and combine to form an upper surface 36 of bottom lining 30. In the embodiment shown, surfaces 42*a*, 44*a*, 46*a*, 48*a*, 52*a*, 54*a*, 56*a*, 58*a* are each parallel and horizontal when ladle 10 is in a normal operating orientation. Surface 42*a* has an elevation higher than an elevation of surfaces 44*a*, 46*a*, 48*a*, 52*a*, 54*a*, 56*a*, 58*a*. Surfaces 44*a*, 46*a*, 48*a*, 52*a*, 54*a*, 56*a* are each dimensioned to have a different elevation such that surface 44*a* is higher than surface 46*a*, surface 46*a* is higher than surface 48*a*, and so forth until surface 56*a*, that has an elevation less than surfaces 44*a*, 46*a*, 48*a*, 52*a*, 54*a*. Surface 58*a* has an elevation lower than surface 56*a*. Surfaces 42*a*, 44*a*, 46*a*, 48*a*, 52*a*, 54*a*, 56*a*, 58*a* are arranged to form a series of successive steps, wherein each surface steps downwardly from surface 42*a*, to surfaces 44*a*, 46*a*, 48*a*, 52*a*, 54*a*, 56*a* to surface 58*a*.

In the embodiment shown, bottom lining 30 is formed by molding sections 42, 44, 46, 48, 52, 54, 56, 58 using a single mold (not shown) or using conventionally known forms (not shown). For the method wherein bottom lining 30 is formed in a single mold, a bottom of the mold is dimensioned to match upper surface 36. In this respect, when a refractory material is poured into the mold, upper surface 36 of bottom lining 30 is formed in the bottom of the mold. Bottom lining 30 is then removed from the mold and inverted such that upper surface 36 of bottom lining 30 faces upward. For the method of forming bottom lining 30 using conventional forms, lowermost section 58 is formed first. Conventionally known forms are then used to aid in forming the remaining sections 42, 44, 46, 48, 52, 54, 56 of bottom lining 30 starting with intermediate section 56, then intermediate section 54 and so forth.

Refractory material, used to form bottom lining 30, is selected based upon the desired operating characteristics and performance parameters of bottom lining 30. Various high-temperature refractory castables may find advantageous application in the present invention. In the embodiment of the present invention wherein bottom lining 30 is a monolithic, refractory slab, a low-moisture, high alumina castable, manufactured and sold by North American Refractories Co. under the trade designations D-CAST 85 GOLD or HP-CAST ULTRA is used. Castables having 80% alumina content or higher are preferred. In an embodiment wherein bottom lining 30 is comprised of refractory bricks, an alumina-magnesia-carbon brick, manufactured and sold by North American Refractories Co, under the trade designations COMANCHE FA or COMANCHE FA MX may be used.

Figure 4:
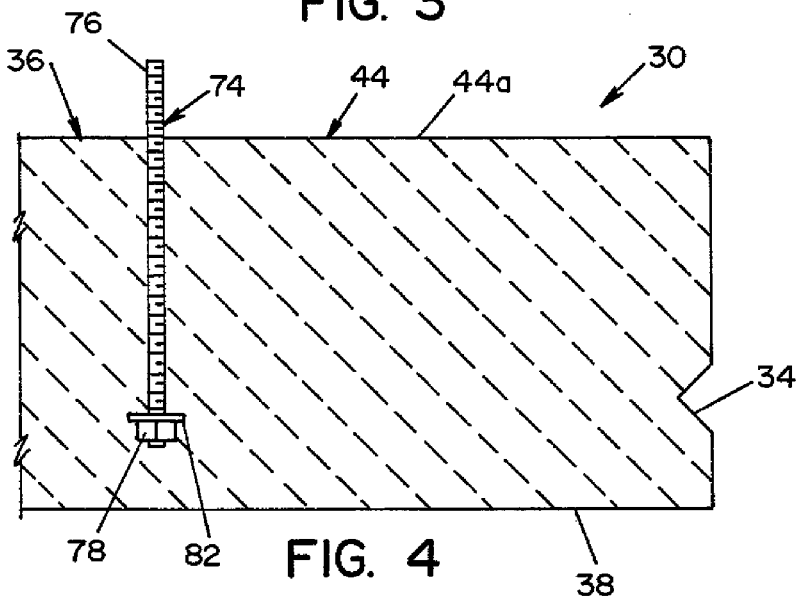
FIG. 4 is a sectional view taken along lines 4-4 of FIG. 3, showing a cross-section of the bottom lining.

Spaced-apart lifting pin assemblies 74 are embedded within bottom lining 30, as best seen in FIG. 4, when bottom lining 30 is formed. Each lifting pin assembly 74 is basically comprised of a threaded rod 76 that is threaded into a matching nut 78 that in turn is welded to a flat metallic washer 82. Several lifting pin assemblies 74 are set into bottom lining 30 at spaced-apart locations when bottom lining 30 is formed. Pin assemblies 74 facilitate movement of bottom lining 30 from its point of fabrication to its ultimate location within ladle 10.

U.S. Pat. No. 6,673,306 entitled "Refractory Lining For Metallurgical Vessel" and U.S. Pat. No. 6,787,098 entitled "Refractory Lining For Metallurgical Vessel," which are expressly incorporated herein by reference, describe bottom linings for ladles that are pre-formed.

As best seen in FIG. 1, refractory well block 66 is dimensioned to be disposed in opening 59 of bottom lining 30. An upper nozzle 68 that is part of a slide gate assembly 72, shown in phantom, is inserted into well block 66.

The present invention shall now be described with respect to assembling bottom lining 30 into ladle 10. Bottom lining 30 may be fabricated, as described above, at a location remote from a place where ladle 10 is used to cast molten steel. It is also contemplated that bottom lining 30 may be fabricated at a mill. Whether bottom lining 30 is formed at a remote location or at a mill, bottom lining 30 is then placed within bottom 14 of ladle 10 using spaced-apart lifting assemblies 74. As shown in FIGS. 1 and 2, bottom lining 30 is dimensioned to form a slight gap 62 between refractory lining 22 of ladle 10 and the peripheral edge of bottom lining 30, as best seen in FIG. 1. Well block 66 is positioned within bottom lining 30 after bottom lining 30 is placed in ladle 10. Well block 66 is located in opening 59 below surface 58*a* of lowermost section 58 such that a recess 61 is formed in bottom lining 30. Gap 62 is filled with a conventionally known, refractory castable or ramming material 64 to complete the refractory lining covering bottom 14 of ladle 10. In this respect, castable or ramming material 64 also fills V-shaped slot 34 to aid in securing bottom lining 30 in ladle 10.

The present invention shall now be described with respect to a steel casting operation using ladle 10. Referring now to FIGS. 1-4, a ladle 10 having a bottom lining 30 illustrating a first embodiment of the present invention is shown. As described above, there is typically a carryover of slag from a metallurgical furnace into ladle 10. The slag typically forms a slag layer that floats on top of the molten metal in ladle 10. The molten metal in ladle 10 is cast from ladle 10 through well block 66 when slide gate assembly 72 is opened. As the molten metal in ladle 10 drains from ladle 10, the level of the molten metal decreases. As the level of the molten metal decreases, a point is reached wherein the level of the molten metal in ladle 10 is equal to the level of surface 42*a* of uppermost section 42. At this point, the slag layer floating on the molten metal engages surface 42*a* of uppermost section 42. As the level of the molten metal continues to decrease, the slag above surface 42*a* of uppermost section 42 has a tendency to adhere to surface 42*a* of uppermost section 42. In other words, a portion of the slag floating on the molten metal is retained on surface 42*a* of uppermost section 42 as the molten metal continues to drain from ladle 10.

As the level of the molten metal continues to decrease, a point is reached wherein the level of the molten metal in the ladle is equal to the elevation of surface 44*a* of intermediate section 44. As the level of the molten metal continues to decrease, the slag above surface 44*a* of intermediate section 44 begins to adhere, i.e., is retained, on surface 44*a* of intermediate section 44. In this respect, as molten metal continues to drain out of ladle 10, slag has a tendency to adhere and be retained on surfaces 46*a*, 48*a*, 52*a*, 54*a*, 56*a*, 58*a* in a similar manner as described above for surface 42*a* of uppermost section 42. In other words, as the molten metal is drained from ladle 10, the level of the molten metal in ladle 10 decreases such that slag is first retained on surface 42*a* of uppermost section 42, then slag is retained on surface 44*a* of intermediate section 44, then slag is retained on surface 46*a* of intermediate section 46, and so forth until slag is retained on surface 58*a* of lowermost section 58. Bottom lining 30 is designed such that as molten metal is drained from ladle 10, slag adheres to and is retained on successive stepped surfaces, namely surfaces 42*a*, 44*a*, 46*a*, 52*a*, 54*a*, 56*a*, 58*a*, as the level of the molten metal in ladle 10 decreases.

The casting of the molten metal from ladle 10 is preferably stopped before slag above well block 66 is entrained into the stream of molten metal exiting ladle 10. In this respect, the casting of molten metal from ladle 10 may be stopped when the level of the molten metal in ladle 10 is between surface 42*a* of uppermost section 42 and surface 58*a* of lowermost section 58.

The present invention therefore provides a stepped bottom lining that collects, i.e., retains, slag on an upper surface of the bottom lining, thereby reducing the amount of slag that may exit the ladle when the molten metal is drained from the ladle. The present invention also provides a stepped bottom lining that can improve yield by reducing the amount of residual molten metal remaining in a ladle at the end of a casting process.

Referring now to another aspect of the present invention, it is generally known that the draining of molten metal from ladle 10 may also cause a vortex, i.e., a swirling motion, to form in the molten steel above well block 66 once the level of molten metal in ladle 10 reaches a critical level. This vortex can cause the slag floating on the molten metal to be entrained into the molten metal exiting the ladle 10. In the northern hemisphere, when fluid drains from a tank, a vortex forms within the tank causing the fluid to rotate in a clockwise direction. Bottom lining 30 of the present invention is designed to facilitate flow of the molten metal in ladle 10 in a counter-clockwise direction to retard the formation of the vortex in ladle 10. In this respect, as molten metal is drained from ladle 10 and the level of the molten metal in ladle 10 decreases, successive sections 42, 44, 46, 48, 52, 54, 56, 58 of upper surface 36 are exposed. At one point the level of the molten metal in ladle 10 is between surface 42*a* of uppermost section 42 and surface 44*a* of intermediate section 44. As the level of the molten metal continues to decrease, molten metal above surface 44*a* of intermediate section 44 flows toward a surface at a lower elevation, i.e., surface 46*a* of intermediate section 46. In this respect, the molten metal above intermediate section 44 flows in a counter-clockwise direction towards intermediate section 46. This flow of molten metal, beneath the slag layer, is repeated for each successive section 46, 48, 52, 54, 56. The molten metal flows from successive sections 42, 44, 46, 48, 52, 54, 56 of upper surface 36 along a path "B-B" in a counter-clockwise direction. In this respect, bottom lining 30 is designed so that exposure of successive sections 42, 44, 46, 48, 52, 54, 56, 58 of upper surface 36, creates flow of molten metal in a counter-clockwise direction. It is believed that the flow of molten metal in the counter-clockwise direction, created by exposure of successive stepped sections 42, 44, 46, 48, 52, 54, 56, 58, retards the formation of the vortex in the molten metal in ladle 10 above well block 66. Retarding the formation of the vortex in the molten metal reduces the likelihood of slag floating on the molten metal being entrained into metal exiting through well block 66. The present invention, therefore, also provides a stepped bottom lining that retards the formation of a vortex in molten metal in a ladle by creating a flow opposite to the natural flow of the molten metal in the ladle. It is believed that this counter flow reduces the amount of slag that may exit the ladle when the molten metal is drained from ladle.

Figure 5:
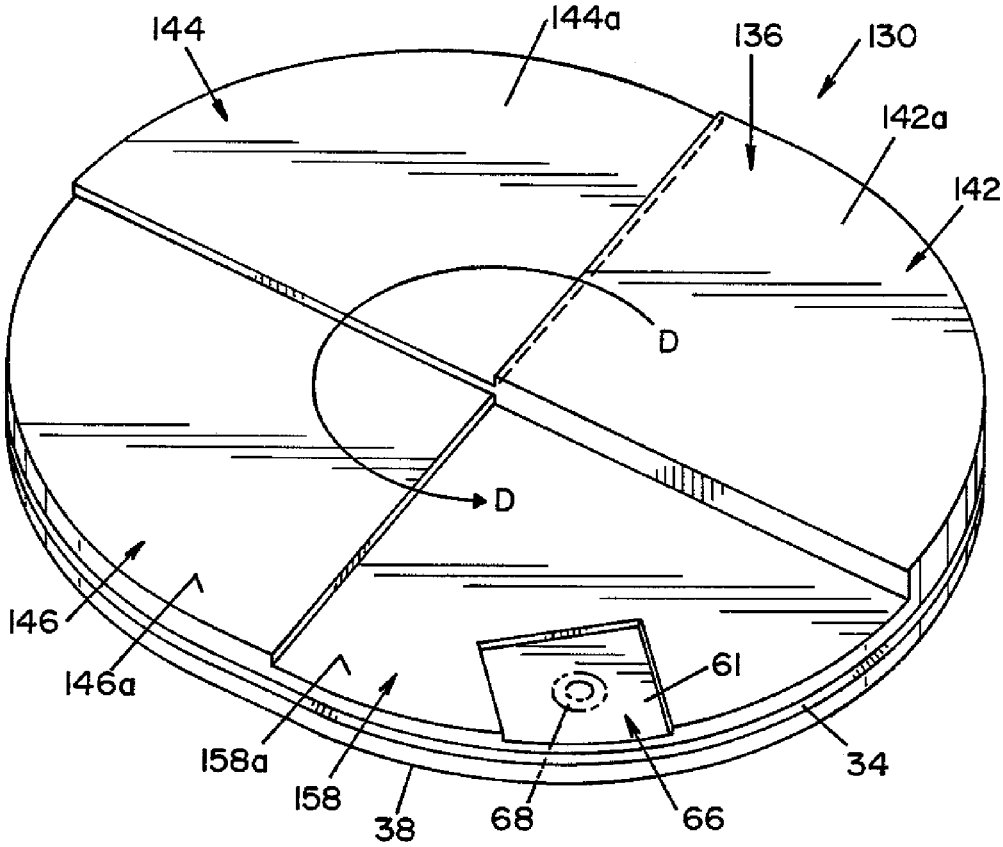
FIG. 5 is a perspective view of a bottom lining, illustrating a second embodiment of the present invention.

Referring now to FIG. 5, a bottom lining 130 illustrating a second embodiment of the present invention is shown. Elements of the second embodiment that are substantially the same as elements of the first embodiment, shown in FIGS. 1-4, have been given the same reference numbers and shall not be described in detail. Bottom lining 130 is similar in most respects to bottom lining 30. In one embodiment, bottom lining 130 is comprised of a castable refractory material. In an alternative embodiment (not shown), bottom lining 130 is comprised of refractory bricks or a combination of a castable refractory material and refractory bricks. Bottom lining 130 has an upper portion comprised of an uppermost section 142, two (2) intermediate sections 144, 146 and a lowermost section 158. In this respect bottom lining 130 has two (2) intermediate sections 144, 146 whereas bottom lining 30 has six (6) intermediate sections 44, 46, 48, 52, 54, 56. Uppermost section 142 has an upper surface 142*a*, intermediate section 144 has an upper surface 144*a*, intermediate section 146 has an upper surface 146*a* and lowermost section 158 has an upper surface 158*a*. In the embodiment shown, upper surfaces 142*a*, 144*a*, 146*a*, 158*a* are each parallel and horizontal when ladle 10 is in a normal operating orientation. An upper surface 136 is formed by combining surfaces 142*a*, 144*a*, 146*a*, 158*a*.

Well block 66 is placed in bottom lining 130 after bottom lining 130 is placed in ladle 10. Well block 66 is placed in bottom lining 130 below surface 158*a* of lowermost section 158 such that a recess 61 is formed therein, as best seen in FIG. 5.

The present invention shall now be described with respect to a steel casting operation using bottom lining 130 in ladle 10. The casting of steel using bottom lining 130 in ladle 10 is similar in most respects to casting steel using bottom lining 30 in ladle 10. In the second embodiment, the slag adheres to surfaces 142*a*, 144*a*, 146*a*, 158*a* instead of surfaces 42*a*, 44*a*, 46*a*, 48*a*, 52*a*, 54*a*, 56*a*, 58*a*, as described above for the first embodiment. In addition, as molten metal drains from ladle 10, the molten metal above upper surface 136 and beneath the slag layer flows from successive sections 142, 144, 146, 158 of upper surface 136 along a path "D-D" in a counter-clockwise direction. In this respect, bottom lining 130 is designed so that exposure of four (4) successive sections 142, 144, 146, 158 of upper surface 136, creates flow of molten metal in a counter-clockwise direction. The first embodiment, as described above, includes six (6) successive sections that are exposed to create flow of molten metal in a counter-clockwise direction.

Figure 6:
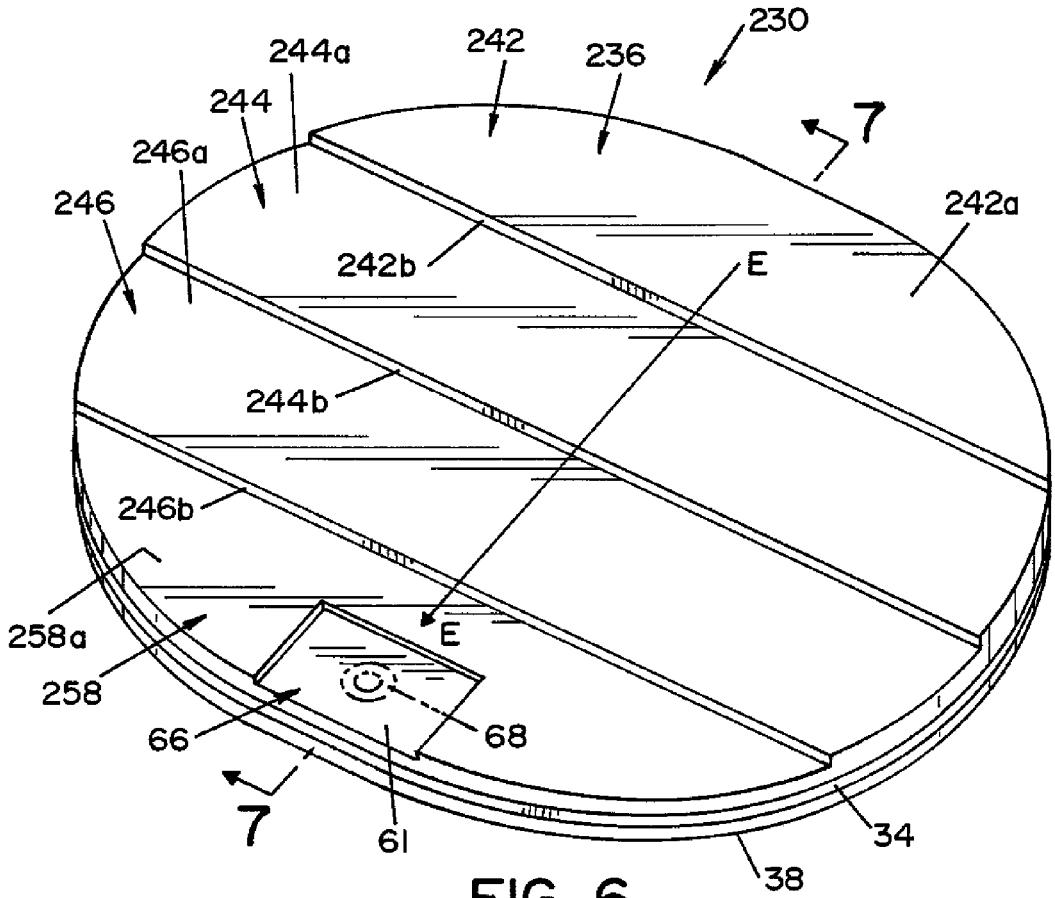
FIG. 6 is a perspective view of a bottom lining, illustrating a third embodiment of the present invention.
Figure 7:
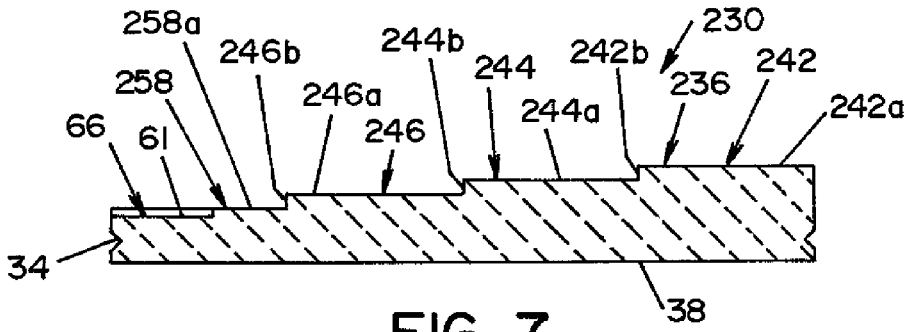
FIG. 7 is a sectional view taken along lines 7-7 of FIG. 6, showing a cross-section of the bottom lining.

Referring now to FIGS. 6-7, a bottom lining 230 illustrating a third embodiment of the present invention is shown. As best seen in FIG. 6, bottom lining 230 is generally oblong in shape and has an upper portion comprised of discrete sections. In the embodiment shown, the upper portion of bottom lining 230 is comprised of an uppermost section 242, two (2) intermediate sections 244, 246 and a lowermost section 258. Uppermost section 242, intermediate sections 244, 246 and lowermost section 258 are basically elongated sections that transverse the upper portion of bottom lining 230. Uppermost section 242 has an upper surface 242*a* and an edge 242*b*. Intermediate section 244 has an upper surface 244*a* and an edge 244*b*. Intermediate section 246 has an upper surface 246*a* and an edge 246*b*. Lowermost section 258 has an upper surface 258*a*. In the embodiment shown, edges 242*b*, 244*b*, 246*b* are parallel to each other. Surfaces 242*a*, 244*a*, 246*a*, 258*a* are each disposed at a discrete elevation and combine to form an upper surface 236. In the embodiment shown, surfaces 242*a*, 244*a*, 246*a*, 258*a* are each parallel and horizontal when ladle 10 is in a normal operating orientation. Surface 242*a* has an elevation higher than an elevation of surfaces 244*a*, 246*a*, 258*a*. Surfaces 244*a*, 246*a* are each dimensioned to have a different elevation such that surface 244*a* is higher than surface 246*a*. Surface 258*a* has an elevation lower than surface 246*a*. Surfaces 242*a*, 244*a*, 246*a*, 258*a* are arranged to form a series of successive steps, wherein each surface steps downwardly from surface 242*a*, to surfaces 244*a*, 246*a* to surface 258*a*.

Well block 66 is positioned within bottom lining 230 after bottom lining 230 is placed in ladle 10. Well block 66 is placed in bottom lining 230 below surface 258*a* of lowermost section 258 such that a recess 61 is formed therein, as best seen in FIG. 6.

The present invention shall now be described with respect to a steel casting operation using bottom lining 230 in ladle 10. As described above, a slag layer typically floats on top of the molten metal in ladle 10. As the molten metal in ladle 10 is cast from ladle 10, the level of the molten metal decreases and a portion of the slag floating on the molten metal adheres to and is retained on surface 242*a* of uppermost section 242. As molten metal continues to drain out of ladle 10, slag has a tendency to adhere to and be retained on surfaces 246*a*, 248*a*, 258*a*. In other words, as the molten metal is drained from ladle 10, the level of the molten metal in ladle 10 decreases such that slag is first retained on surface 242*a* of uppermost section 242, then slag is retained on surface 244*a* of intermediate section 244, then slag is retained on surface 246*a* of intermediate section 246 until slag is retained on surface 258*a* of lowermost section 258. Bottom lining 230 is designed such that as molten metal is drained from ladle 10, slag adheres to and is retained on successive stepped sections, namely uppermost section 242, intermediate sections 244, 246 and lowermost section 258, as the level of the molten metal in ladle 10 decreases.

Similar to the first embodiment, as the level of molten metal decreases, the molten metal above upper surface 236 and beneath the slag layer, flows from successive sections 242, 244, 246, 258 of upper surface 236 along a path "E-E." In this respect, bottom lining 230 is designed so that exposure of successive stepped sections 242, 244, 246, 258 causes molten metal to flow in a direction along the path "E-E."

Figure 8:
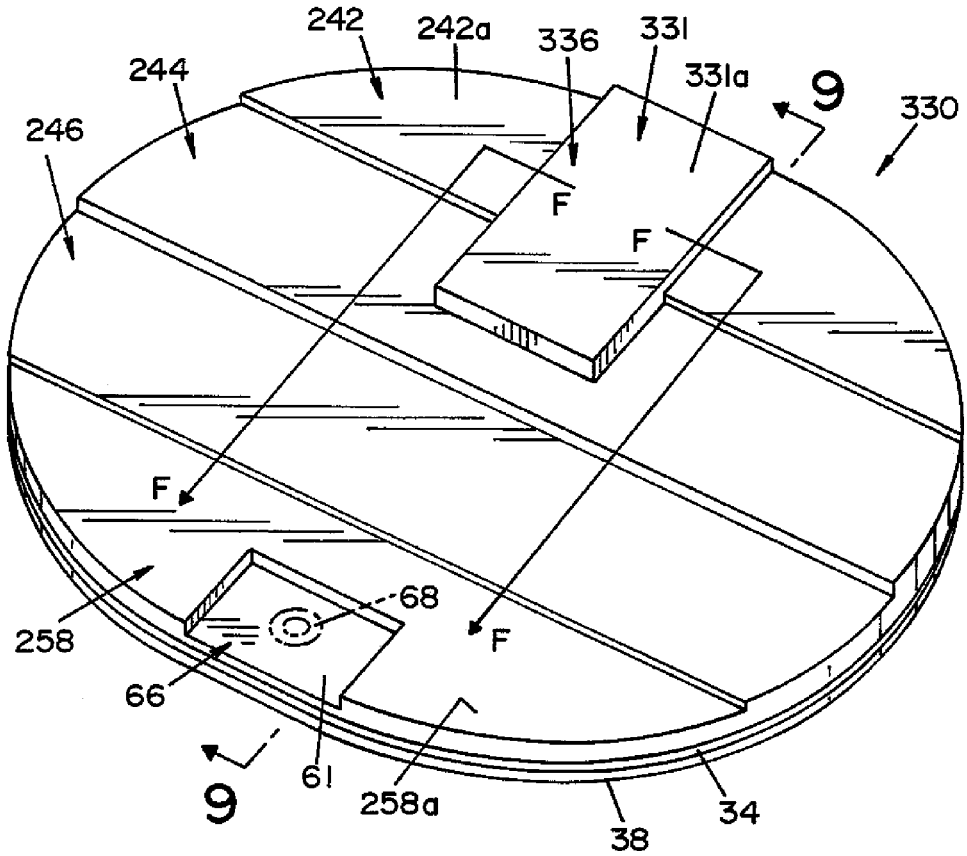
FIG. 8 is a perspective view of a bottom lining, illustrating a fourth embodiment of the present invention.
Figure 9:
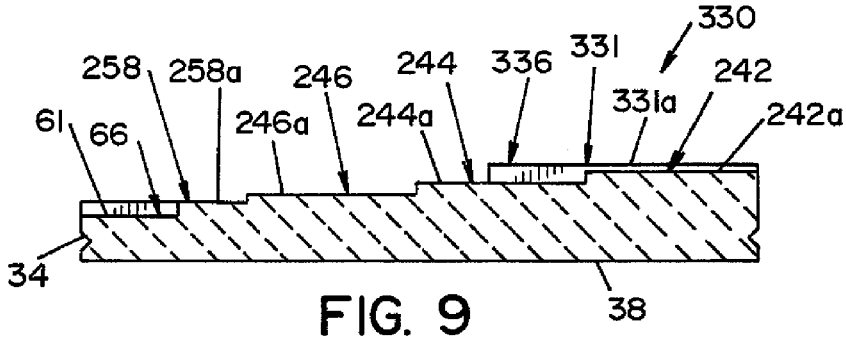
FIG. 9 is a sectional view taken along lines 9-9 of FIG. 8, showing a cross-section of the bottom lining.

Referring now to FIGS. 8-9, a bottom lining 330 illustrating a fourth embodiment of the present invention is shown. Elements of the forth embodiment that are substantially the same as elements of the third embodiment, shown in FIGS. 6-7, have been given the same reference numbers and shall not be described in detail. Bottom lining 330 is similar in most respects to bottom lining 230. Bottom lining 330 has an upper portion comprised of an uppermost section 242, two (2) intermediate sections 244, 246, a lowermost section 258 and an impact pad 331. In this respect bottom lining 330 includes impact pad 331 whereas bottom lining 230 does not include an impact pad. Impact pad 331 has an upper surface 331*a*. An upper surface 336 is formed by combining surfaces 242*a*, 244*a*, 246*a*, 258*a*, 331*a*.

In the embodiment shown, impact pad 331 is a rectangular member typically comprised of a cast, refractory material. In another embodiment (not shown), impact pad 331 is comprised of a plurality of tightly packed high-density and high-temperature refractory bricks or a combination of a cast, refractory material and refractory bricks. In the embodiment shown, impact pad 331 is embedded in bottom lining 330.

The casting of molten metal from ladle 10 containing bottom lining 330 is similar, in most respects, to casting molten metal from ladle 10 containing bottom lining 230. In the embodiment wherein bottom lining 330 is disposed in ladle 10, as molten metal is drained from ladle 10, the level of the molten metal decreases. As the level of the molten metal decreases, a point is reached wherein the level of the molten metal in ladle 10 is equal to the level of surface 331*a* of impact pad 331. At this point, the slag layer floating on the molten metal engages surface 331*a* of impact pad 331 such that the slag adheres to surface 331*a* of impact pad 331. As the level of the molten metal continues to decrease, slag adheres to successive sections 242, 244, 246, 258, as described above for bottom lining 230.

As the level of the molten metal in ladle 10 decreases, molten metal above surface 331*a* of impact pad 331 flows towards surface 242*a* of uppermost section 242 or towards surface 244*a* of intermediate section 244. As the molten metal continues to drain out of ladle 10, the molten metal above surface 336 flows to successive stepped sections 246, 258, as described above for bottom lining 230. The molten metal flows from successive stepped surfaces 331*a*, 242*a*, 244*a*, 246*a*, 258*a* of upper surface 336 along L-shape paths "F-F." In this respect, bottom lining 330 is designed so that exposure of successive surfaces 331*a*, 242*a*, 246*a*, 258*a*, creates flow of molten metal towards well block 66 along paths "F-F."

Figure 10:
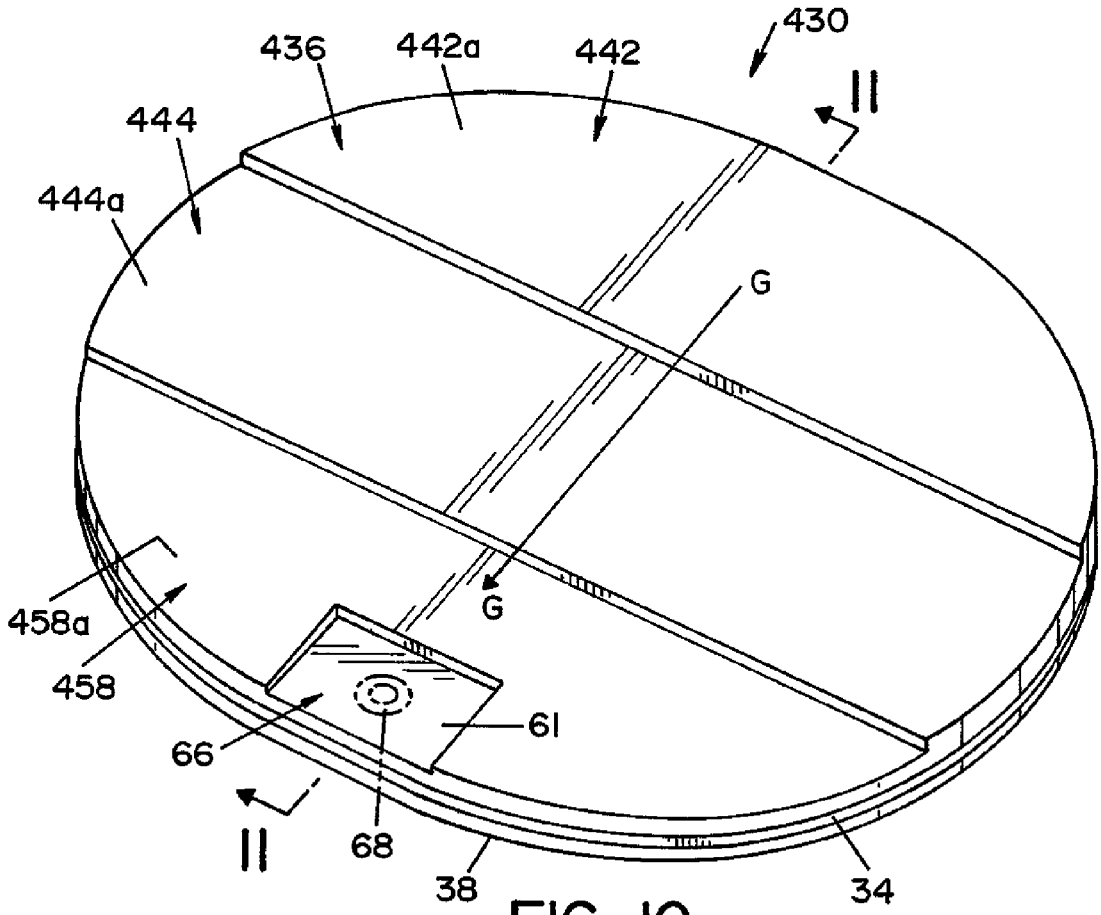
FIG. 10 is a perspective view of a bottom lining, illustrating a fifth embodiment of the present invention.
Figure 11:
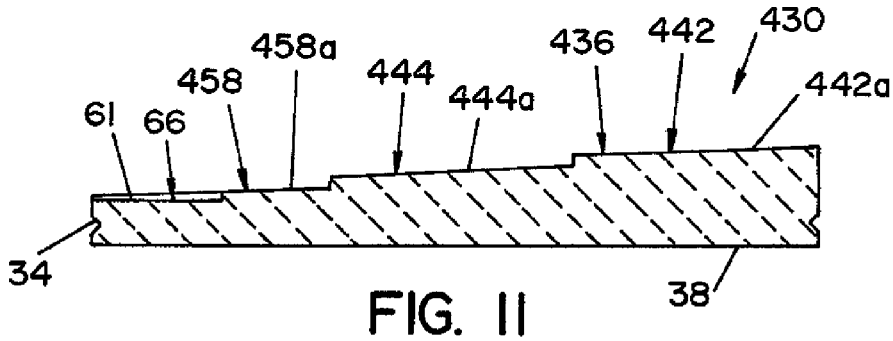
FIG. 11 is a sectional view taken along lines 11-11 of FIG. 10, showing a cross-section of the bottom lining.

Referring now to FIGS. 10-11, a bottom lining 430 illustrating a fifth embodiment of the present invention is shown. Elements of the fifth embodiment that are substantially the same as elements of the third embodiment shown in FIGS. 6-7 have been given the same reference numbers and shall not be described in detail.

Bottom lining 430 has an upper portion comprised of an uppermost section 442, an intermediate section 444 and a lowermost section 458. In this respect, bottom lining 430 has one (1) intermediate section 444 whereas bottom lining 230 has two (2) intermediate sections 244, 246. Uppermost section 442 has an upper surface 442*a*, intermediate section 444 has an upper surface 444*a* and lowermost section 458 has an upper surface 458*a*. In the embodiment shown, surfaces 442*a*, 444*a*, 458*a* each generally slope downwardly towards well block 66, as best seen in FIG. 11, when ladle 10 is in a normal operating orientation. Surfaces 442*a*, 444*a*, 458*a* combine to form an upper surface 436. In this respect, bottom lining 430 has stepped surfaces 442*a*, 444*a*, 458*a* that each are sloped whereas bottom lining 230 has stepped surfaces 242*a*, 244*a*, 246*a*, 258*a* that each are horizontal.

The operation of casting steel from ladle 10 having bottom lining 430 is similar to casting steel from ladle 10 having bottom lining 230 and shall not be described in detail. Bottom lining 430 is designed to have an upper surface 436 such that the flow of molten metal along path "G-G" (as shown in FIG. 10), is aided by sloping surfaces 442*a*, 444*a*, 458*a* of upper surface 436 toward well block 66.

It should be understood that a bottom lining, according to the present invention, may assume other shapes and configurations without deviating from the present invention. For example, bottom linings, 30, 130, 230, 330, 430 each show sections of upper surfaces 36, 136, 236, 336, 436 that are generally planar. It is also contemplated that upper surfaces 36, 136, 236, 336, 436 may have sections that are non-planar, e.g., convex-shaped or concave-shaped to facilitate a desired flow of metal within ladle 10. Furthermore, in an alternative embodiment of the present invention all or at least a portion of the refractory cast material of bottom lining 30, 130, 230, 330, 430 may be substituted with refractory bricks. It should be further appreciated that each embodiment of the bottom lining described above may be modified to incorporate one or more features of the other embodiments. For example, FIGS. 1-9 show sections of upper surfaces 36, 136, 236, 336 that are horizontal. It is contemplated that sections of upper surfaces 36, 136, 236, 336 may also be sloped, similar to sections 442, 444, 458 of upper surface 436, as shown in FIGS. 10-11.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A refractory bottom for a metallurgical vessel, comprised of:

a bottom lining having a bottom surface that is dimensioned to overlay a bottom of a metallurgical vessel and an upper surface, said upper surface consisting essentially of a plurality of discrete sections including an uppermost section, at least two intermediate sections and a lowermost section, each section having an upper surface at a predetermined elevation wherein said upper surface of said uppermost section has a highest elevation, said upper surface of said lowermost section has a lowest elevation, and said intermediate sections each have an intermediate elevation that are different from each other and disposed between said highest elevation and said lowest elevation, all of said sections forming said upper surface of said bottom lining being at a different elevation and being arranged in elevation-descending order from said uppermost section to said lowermost section to define a continuously downward stepped path from said uppermost section to said lowermost section, wherein each successive section along said continuously downward stepped path is lower than a preceding section in said continuously downward stepped path and wherein each of said sections is pie-shaped and said pie-shaped sections are disposed such that said continuously downward stepped path is circular; and an opening extending through said lowermost section of said bottom lining to allow a molten metal to drain from said vessel.

2. A refractory bottom according to claim 1, wherein each of said pie-shaped sections include a point from which said pie-shaped section extends, said point disposed near a central portion of said bottom lining.

3. A refractory bottom according to claim 2, wherein said points of said pie-shaped sections all are disposed at a common point.

4. A refractory bottom according to claim 3, wherein said common point is a center point of said bottom lining.

5. A refractory bottom according to claim 1, wherein said circular path has a counter-clockwise direction.

6. A refractory bottom according to claim 1, wherein each discrete section is horizontal.

7. A refractory bottom according to claim 1, wherein a well block is disposed in said opening in said bottom lining.

8. A refractory bottom according to claim 7, wherein said well block has an upper surface, said upper surface of said well block being disposed at an elevation below said lowermost section.

9. A refractory bottom according to claim 1, wherein said bottom lining is comprised of a refractory castable.

10. A refractory bottom according to claim 1, wherein said bottom lining is comprised of refractory bricks.

11. A refractory bottom according to claim 1, wherein said bottom lining is comprised of a combination of a refractory castable and refractory bricks.

12. A refractory bottom for a metallurgical vessel comprised of:

a bottom lining having an upper surface consisting essentially of an uppermost section, an intermediate section and a lowermost section, all of said sections forming said upper surface of said bottom lining being at a different elevation and being arranged in elevation-descending order from said uppermost section to said lowermost section to define a continuously downward stepped path from said uppermost section to said lowermost section, wherein each successive section along said continuously downward stepped path is lower than a preceding section in said continuously downward stepped path and wherein each of said sections is an elongated section that transverses the upper surface of the bottom lining such that an edge of each section extends from one side of said bottom lining to a substantially opposite side of said bottom lining, said elongated sections disposed such that said continuously downward stepped path is a straight line from one side of said bottom lining to another side of said bottom lining; and an opening extending through said lowermost section of said bottom lining to allow a molten metal to drain from a metallurgical vessel.

13. A refractory bottom according to claim 12, wherein said bottom includes an impact pad.

14. A refractory bottom according to claim 13, wherein said impact pad transverses said uppermost section.

15. A refractory bottom according to claim 12, wherein said uppermost section, said intermediate section and said lowermost section each have an edge, said edges of said sections being parallel to each other.

16. A refractory bottom according to claim 12, wherein said uppermost section, said intermediate section and said lowermost section are horizontal.

17. A refractory bottom according to claim 12, wherein a well block is disposed in said opening in said bottom lining.

18. A refractory bottom according to claim 17, wherein said well block has an upper surface, said upper surface of said well block being disposed at an elevation below said lowermost section.

19. A refractory bottom according to claim 12, wherein said uppermost section, said intermediate section and said lowermost section each are sloped towards said opening in said bottom lining.

20. A refractory bottom according to claim 12, wherein said bottom lining is comprised of a refractory castable.

21. A refractory bottom according to claim 12, wherein said bottom lining is comprised of refractory bricks.

22. A refractory bottom according to claim 12, wherein said bottom lining is comprised of a combination of a refractory castable and refractory bricks.

* * * * *